US008210877B2

(12) United States Patent
Droesbeke

(10) Patent No.: US 8,210,877 B2
(45) Date of Patent: Jul. 3, 2012

(54) MODULAR CONNECTOR

(75) Inventor: Gert Droesbeke, Geel (BE)

(73) Assignee: FCI, Versailles (FR)

( * ) Notice: Subject to any disclaimer, the term of this patent is extended or adjusted under 35 U.S.C. 154(b) by 58 days.

(21) Appl. No.: 12/735,208

(22) PCT Filed: Dec. 17, 2008

(86) PCT No.: PCT/EP2008/067799
§ 371 (c)(1),
(2), (4) Date: Jun. 22, 2010

(87) PCT Pub. No.: WO2009/083460
PCT Pub. Date: Jul. 9, 2009

(65) Prior Publication Data

US 2010/0267288 A1 Oct. 21, 2010

(30) Foreign Application Priority Data

Dec. 28, 2007 (WO) ..... PCT/IB2007/055411

(51) Int. Cl.
*H01R 13/648* (2006.01)

(52) U.S. Cl. ..... 439/607.11; 439/680

(58) Field of Classification Search ..... 439/607.11, 439/607.04, 680
See application file for complete search history.

(56) References Cited

U.S. PATENT DOCUMENTS

| | | | | |
|---|---|---|---|---|
| 5,873,753 | A * | 2/1999 | Norris et al. | 439/752 |
| 6,083,047 | A | 7/2000 | Paagman | 439/608 |
| 6,540,558 | B1 * | 4/2003 | Paagman | 439/607.11 |
| 6,544,045 | B1 * | 4/2003 | Paagman | 439/79 |
| 6,884,117 | B2 * | 4/2005 | Korsunsky et al. | 439/607.11 |
| 7,195,519 | B1 * | 3/2007 | McAlonis et al. | 439/607.39 |
| 2002/0102885 | A1 | 8/2002 | Kline | 439/701 |

FOREIGN PATENT DOCUMENTS

| | | | |
|---|---|---|---|
| EP | 0 854 549 | A2 | 7/1998 |
| WO | WO 01/76016 | A1 | 10/2001 |

* cited by examiner

*Primary Examiner* — Truc Nguyen
(74) *Attorney, Agent, or Firm* — Harrington & Smith

(57) ABSTRACT

An electrical connector includes at least two parts: a housing having a mating side (MS) and a rear side (RS) and a terminal module having a mating side and a rear side. One part includes a mounting structure and the other part includes a corresponding receiving structure for receiving the mounting structure of the other part. The mounting structure extends in a direction from the mating side to the rear side of the part and includes a cross-section perpendicular to that direction, which cross-section has an asymmetric profile.

18 Claims, 5 Drawing Sheets

MODULAR CONNECTOR

FIELD OF THE DISCLOSURE

The present invention relates to the field of connectors. In particular, the present invention relates to the field of modular connectors. More in particular, the present invention relates to the field of electrical connectors for transmitting high speed signals.

BACKGROUND OF THE DISCLOSURE

In the art, various modular connectors are known wherein modules, such as terminal modules, insulating modules and/or spacer modules, are arranged in a housing such as a header or a housing. Different connectors may be formed by assembling different numbers and/or types of modules into the the housing. The modules may be arranged in a side-by-side relationship.

Such connectors, e.g. known from U.S. Pat. No. 6,083,047, are very well suited for transmitting high speed signals. The connector according to U.S. Pat. No. 6,083,047 may be assembled relatively efficiently by virtue of the fact that the modules are provided with a locating and mounting rib having a dove-tail shape which is received in a corresponding slot in the header or housing (indicated with reference numerals 65 and 73, respectively, in the figures of that publication).

However, with the ever increasing signalling speed required by present-day systems the signals transmitted over a contact terminal become more and more sensitive to cross talk with neighbouring contact terminals, also with contacts in adjacent terminal modules or terminal modules separated by one or more spacer modules or other terminal modules. Cross talk between terminals is relatively sensitive to the distance between the terminals. Thus, in order to accurately assess and/or prevent the amount of cross talk on a contact terminal at one or more particular signal frequencies, the relative positions of terminals are important.

Since there is also an ongoing strive towards smaller connectors, there is a desire for a modular connector which allows a relatively compact build while providing a relatively reliable true positioning of terminals, in particular between neighbouring modules.

SUMMARY OF THE DISCLOSURE

An electrical connector according to claim 1 is provided.

Such a connector may be assembled efficiently. The profile having an asymmetric cross-section provides an asymmetric acceptance for manufacturing tolerances of the mounting structure and receiving structures in an assembled state, and therefore improves the localisation and mounting accuracy of the parts relative to each other.

The connector of claim 2 enables the parts to be mounted to each other relatively securely. A fitting arrangement, particularly a relatively tight fitting arrangement, may cause an asymmetric, directional, force of (one or more portions of) the structures against each other, further improving the localisation and mounting accuracy.

In the connector of claim 3 the structures provide attachment of the parts in two directions.

The connector of claim 4 provides a clear definition of the relative localisation of the parts.

The connector of claim 5 facilitates assembly of the parts since the rib and the slot may act as guiding structures during the assembly by inserting the one into the other.

The connectors of claims 6 and/or 7 facilitate assembly of the parts since the structures comprise one or more portions which provide a fitting arrangement and portions which may act for guiding the structures during insertion of one structure into another.

The connector of claim 8 facilitates determining a proper alignment of the parts, based on and/or determined by the perpendicular surfaces, e.g. by these surfaces being in contact with corresponding structures or surfaces.

The connector of claim 9 facilitates defining a proper alignment and thus a proper true positioning of the contact terminals.

The connector of claim 10 is less sensitive to manufacturing tolerances of the edges of the structures such as burrs, roundings etc, and allows corresponding surfaces of the mounting and receiving structures to lie substantially flat against each other.

The connector of claim 11 provides additional structures for mounting or attachment of the parts. Thus, the relative localisation and mounting of the parts may be improved further.

The connector of claim 12 is relatively insensitive to manufacturing debris or wear during assembly of the parts, further improving the localisation and mounting accuracy of the connector.

The connector of claim 13 can be manufactured efficiently.

In another aspect, an electrical connector is provided, comprising at least two parts: a housing having a mating side and a rear side and a terminal module having a mating side and a rear side. One part comprises a mounting rib, preferably on a side thereof, more preferably on a top side thereof, and the other part comprises a corresponding slot for receiving the mounting rib. The mounting rib extends along a direction from the mating side to the rear side of the part and comprises a cross-section perpendicular to that direction which has an asymmetric dove-tail profile.

Such an electrical connector may be assembled relatively efficiently by inserting the mounting rib into the corresponding slot. The asymmetric cross-section of the rib provides an asymmetric acceptance for manufacturing tolerances of the rib and/or the slot and therewith assists determining and correcting localisation of the parts relative to each other.

In another aspect, an electrical connector is provided, comprising a housing having a mating side and a rear side and a terminal module having a mating side and a rear side. The terminal module comprises a mounting rib and the housing comprises a corresponding slot for receiving the mounting rib. The mounting rib extends, preferably on a side of the module, more preferably on a top side thereof, in a direction from the mating side to the rear side of the module and comprises a cross-section perpendicular to that direction which has a half dove-tail profile. The module has a main plane between the mating side and the rear side. The mounting rib comprises two mutually substantially perpendicular surfaces, one of which extends substantially parallel to the main plane of the module.

Such an electrical connector may be manufactured relatively efficiently and reliably and be assembled relatively efficiently. The perpendicular surfaces enable a relatively reliable alignment of the module and the housing and therewith provide a relatively good localisation and mounting accuracy.

The invention will hereafter be fully explained with reference to the drawings showing an embodiment of the invention by way of example.

DETAILED DESCRIPTION OF EMBODIMENTS

Figure 1:
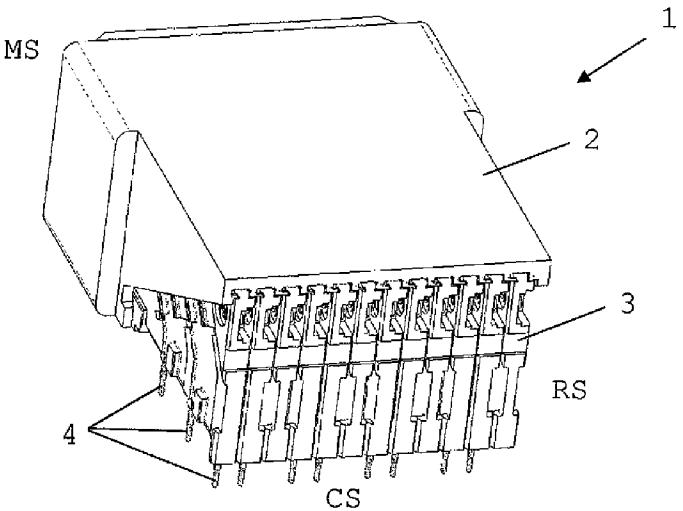
FIG. 1 is a rear view of an electrical connector according to the present invention.
Figure 2:
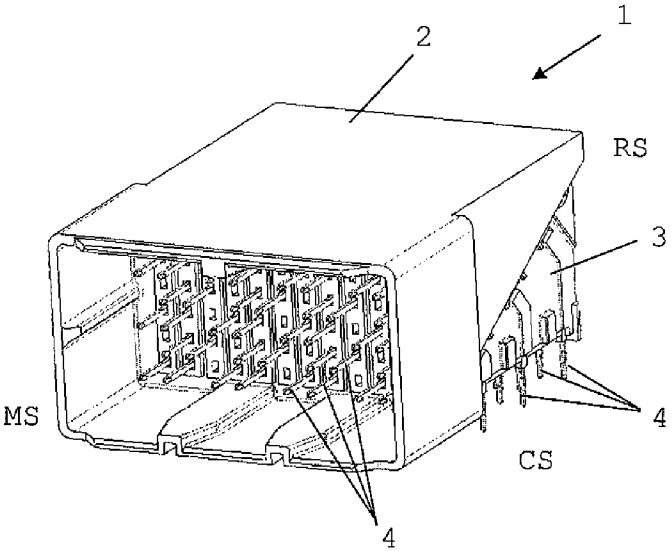
FIG. 2 is a front view of the connector of FIG. 1.
Figure 3:
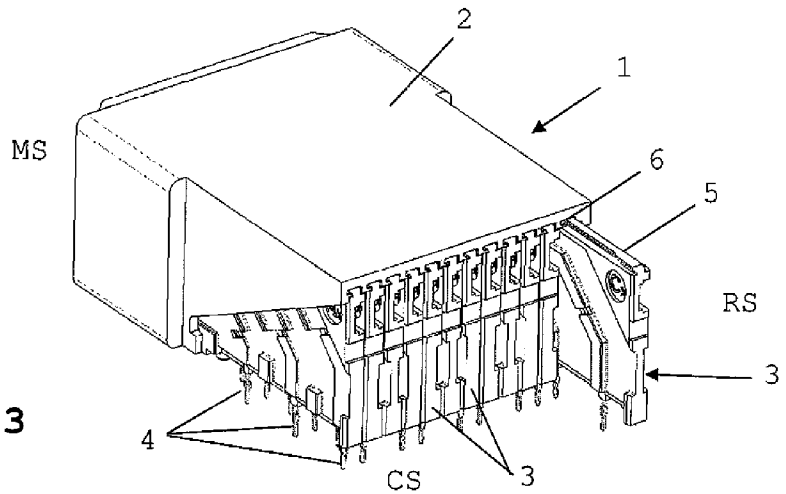
FIG. 3 is a rear view of the connector of FIG. 1, with one terminal module only partially inserted.

FIGS. 1-3 show an electrical connector 1, here in the form of a right-angle board connector, having a front or mating side MS for mating with a counterconnector, a rear side RS and a contact side CS for contact with a printed circuit board (not shown). It should be noted that the connector 1 according to the invention may equally well be formed as a straight connector, a board-to-board mezzanine connector etc.

The connector 1 comprises a housing 2 and a plurality of modules 3. The modules 3 may be identical or different and may comprise any suitable number of contact terminals or no terminals at all, being merely spacer modules. In the embodiment shown, all modules comprise contact terminals 4. Here, the contact terminals 4 extend from the mating side MS of the connector to the contact side CS.

The modules 3 are mounted into the housing 2 from the rear side RS. The modules 3 are attached to the housing 2 by means of rib 5, fitting into a corresponding slot 6 in the housing 2, as will become more clear from the following.

Figure 4A:
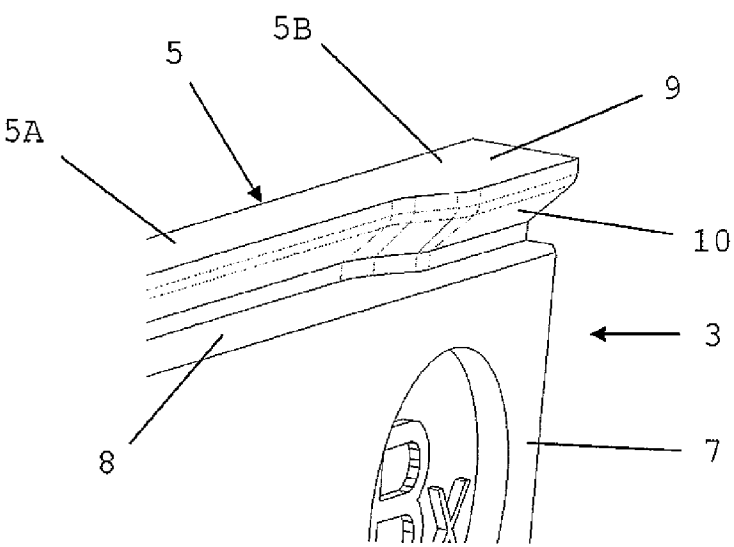
FIGS. 4A and 5A are details on an enlarged scale of FIGS. 4 and 5, respectively, as indicated in these latter Figs.
Figure 4:
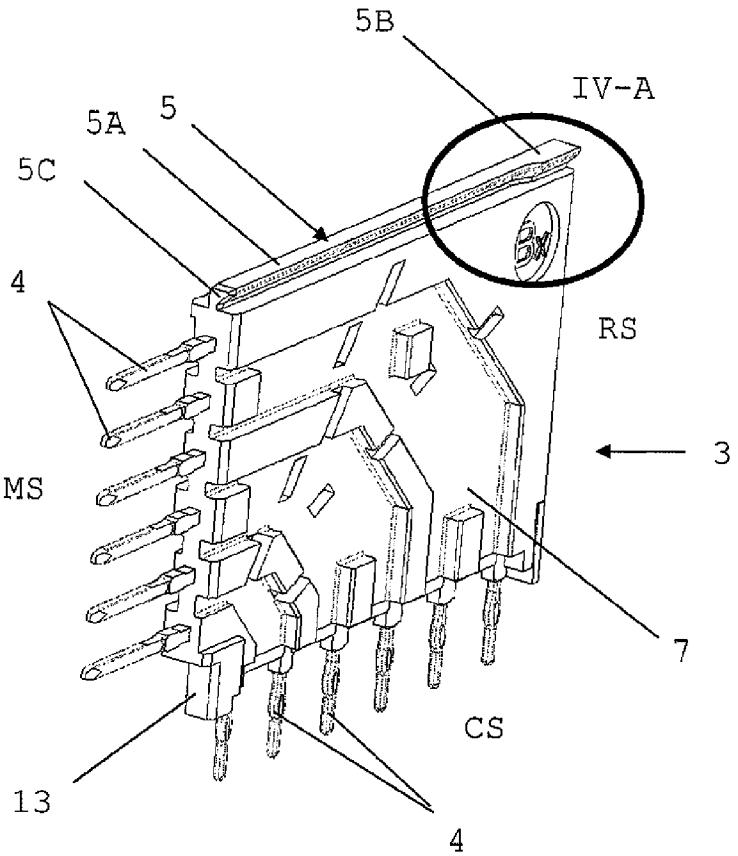
FIGS. 4 and 5 are perspective side views of two different angles of a terminal module.
Figure 5A:
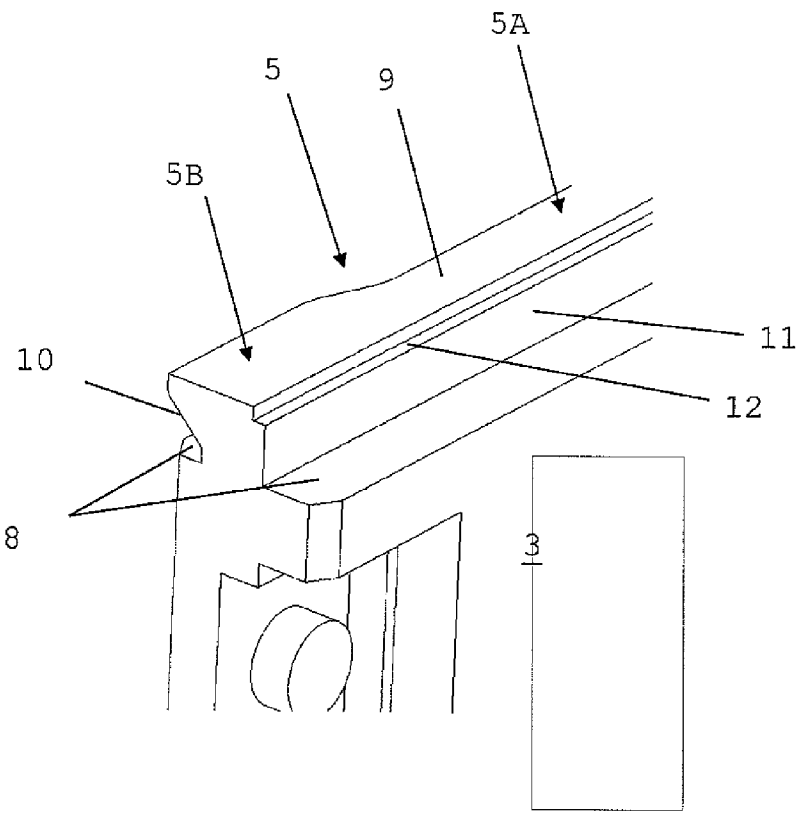
Figure 5:
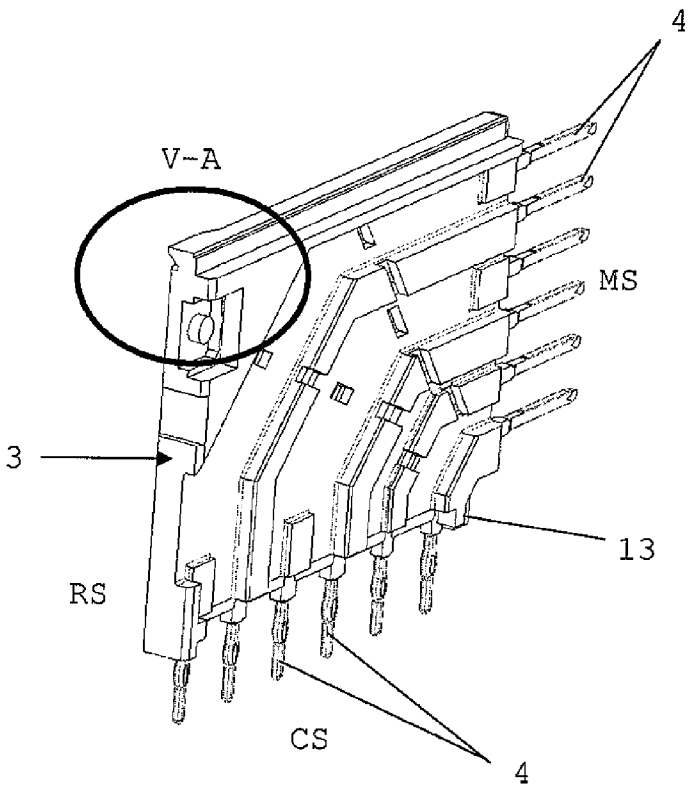

FIGS. 4 and 5 show an exemplary terminal module 3. FIGS. 4A and 5A show the details indicated in FIGS. 4 and 5. In correspondence with the connector 1, the terminal module 3 has a front or mating side MS, a rear side RS and a contact side CS.

The terminal module 3 comprises a molded main body 7 of an insulating material, e.g. plastic, here comprising six conductive terminals 4, e.g. metal. The main body is substantially planar but may comprise various portions of different thickness and/or profiles for different functions, e.g. for manufacturing, attaching shielding elements etc., which fall outside the scope of the present text.

The main body 7 is substantially rectangular, but it may have other shapes, depending on the type of connector. The main body 7 has, substantially perpendicular to its planar extension, a substantially flat top surface 8. The rib 5 is arranged on the top surface 8, extending in a direction from the mating side to the rear side of the module 3. As is most clearly visible in FIG. 5A, the rib comprises a cross-section perpendicular to the direction it extends in, which cross-section has an asymmetric profile defined by an upper surface 9, a flared side surface 10 and a straight side surface 11. Here, the upper surface 9 is substantially parallel to the top surface 8 of the main body 7 of the module 3. The surface 11 is essentially perpendicular to the surfaces 8, 9. The rib 5 thus has a cross-sectional profile that is one half of a regular dove-tail profile, e.g. as known from U.S. Pat. No. 6,083,047.

The rib 5 comprises two portions, 5A and 5B, with cross-sections having mutually different sizes, the portion 5A relatively closest to the mating side MS being narrower than the portion 5B relatively closest to the rear side RS. Except for their widths, both portions 5A, 5B have substantially the same shape and cross-section. The transition from one size to the other is relatively gradually. The upper surface 9 and side surface 11 are straight and are common to both portions 5A, 5B. However it should be appreciated that the positions of the portions 5A and 5B of two adjacent ribs 5 are not necessary arranged in the same side (i.e. close to the mating or the rear side) but may be arranged head to tail with respect one another so as to provide a denser and robust modular connector.

The main body 7 of the terminal module 3 is molded to the contact terminals. The mold for manufacturing the module 3 may comprise two mold-halves, to be joined or joining substantially in a plane, such that the parting line between the mold-halves generally defines a main plane of the module 3, which may be a mid-plane of the module 3. The main plane extends between the mating side MS and the rear side RS in one direction and between the contact side CS and the top side of (the main body 7 of) the module 3. The side surface 11 extends substantially parallel to the main plane of the module 3, preferably the surface 11 lies in that plane.

The contact terminals 4 may be arranged in the main body 7 in the main plane or on one or both sides thereof. The terminals 4 may have any suitable cross-sectional shape such as round, rounded, rectangular or square, and may have any suitable type of connection and gender at either side, such as male (as the ones shown here at the mating side MS), female or hermaphroditic and/or suitable for soldering (as the ones shown here at the contact side CS).

Here, the contact terminals 4 have a generally rectangular cross-section. The terminals 4 are arranged in a plane, such that one side surface of each contact terminal lies substantially in the main plane, coinciding with the parting line between the mold halves. Thus, the side surfaces of the terminals 4 and the side surface 11 of the rib 5 all lie substantially in one plane. This facilitates the design of the mold, the manufacturing process of the module 3 and the alignment of the different parts and portions of the module 3 and of the connector 1 as a whole. This also facilitates the definition of the true position of the terminals 4 in one direction, since distances need only to be defined with respect to that plane.

Along the line where the top surface 9 and the side surface 11 of the rib 5 would join, a cut-out or recess 12 is provided (most clearly seen in FIG. 5A). Further, the front edge 5C of the rib 5 is slightly rounded off (see FIG. 4). The module 3 further comprises a mounting protrusion 13 on the main body 7.

Figure 7:
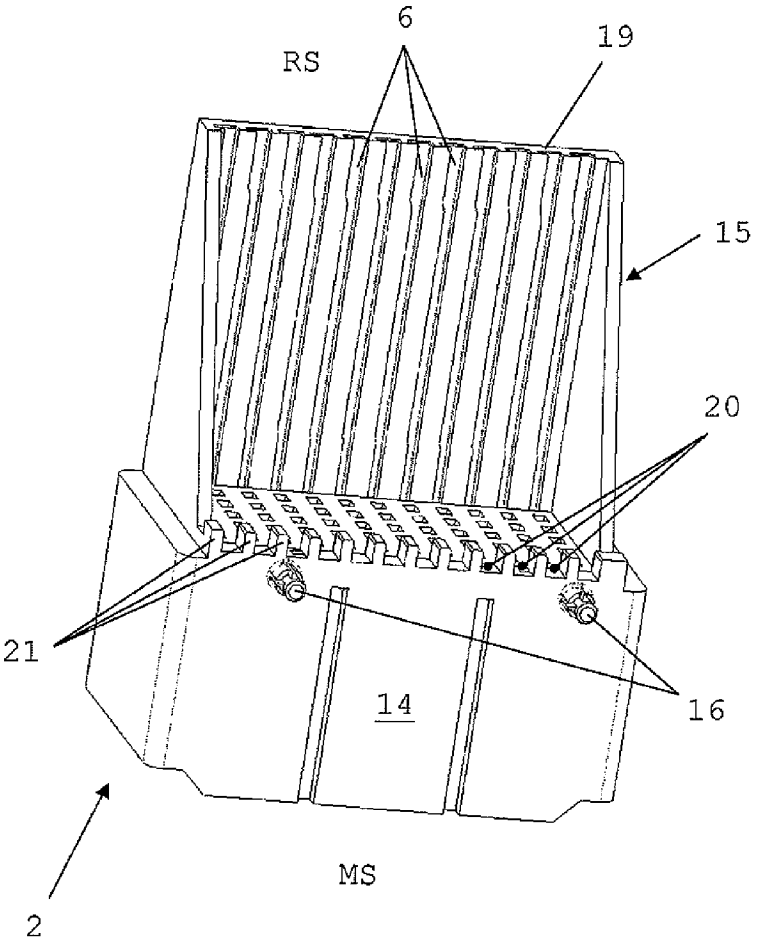
FIGS. 6 and 7 are different views of the housing of the connector of FIG. 1.
Figure 6:
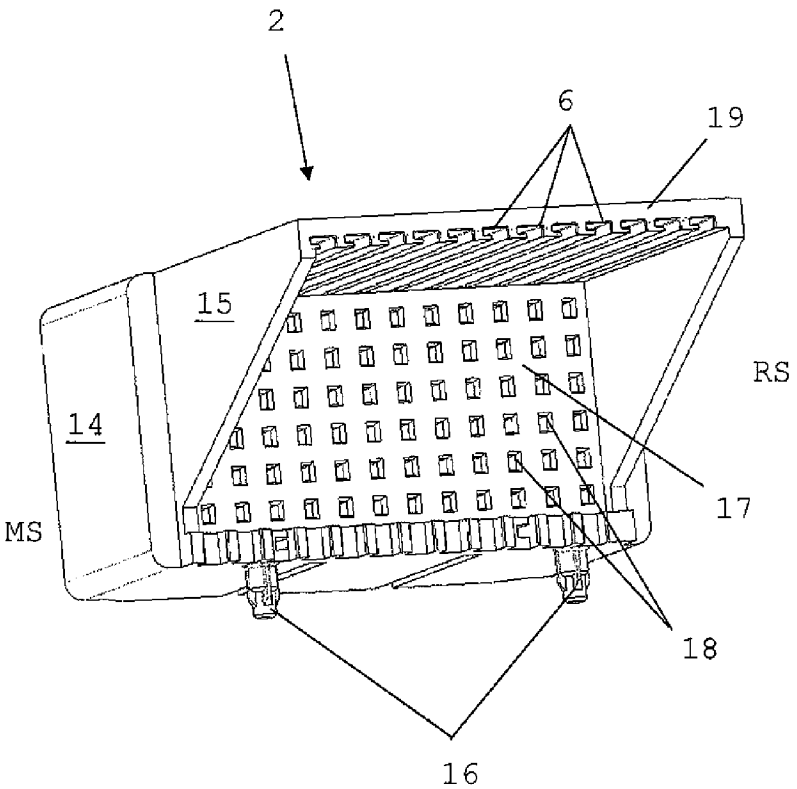

FIGS. 6 and 7 show the housing 2 from the rear (FIG. 6) and from below (FIG. 7), respectively. The housing 2 comprises a front portion 14 at the mating side MS (cf. FIGS. 1-3) and a rear portion 15 at the rear side RS (cf. FIGS. 1-3). The housing is made of insulating material (e.g. plastic). However insofar as the terminals can be accurately guided into the housing without touching it, the housing can be also made in metal by means of Metal Injection Molding process or die-casting process or in metallised plastic. The housing 2 comprises studs 16 for mounting the housing 2 to a circuit board. The interior of the housing 2 is divided in two portions, the front portion 14 and the rear portion 15, by a dividing wall 17 comprising a plurality of passageways 18. In the rear portion 15 the housing 2 further comprises a plurality of recesses or slots 6 in its upper interior wall 19 (cf. FIG. 3) and plurality of recesses 20, defined by protrusions 21. The slots 6 are adapted for receiving a rib 5 of a module 3 (cf. FIG. 3), the passageways 18 are adapted for receiving the contact terminals 4 of a module 3, which are to extend therethrough to the mating side of the connector (see FIG. 2), and the recesses 21 are adapted for receiving a protrusion 13 of a module 3.

Figure 8A:
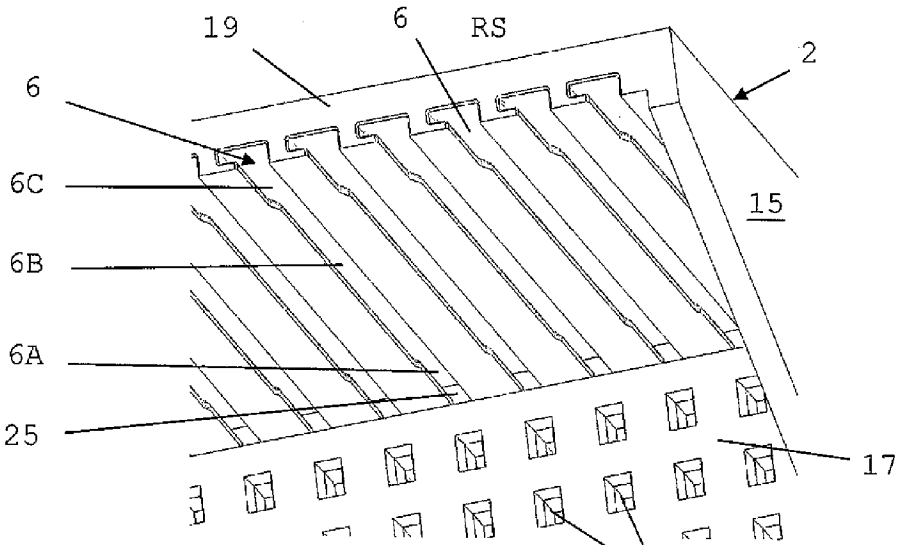
FIGS. 8A-8C are details on an enlarged scale of the housing of FIGS. 6 and 7.
Figure 8C:
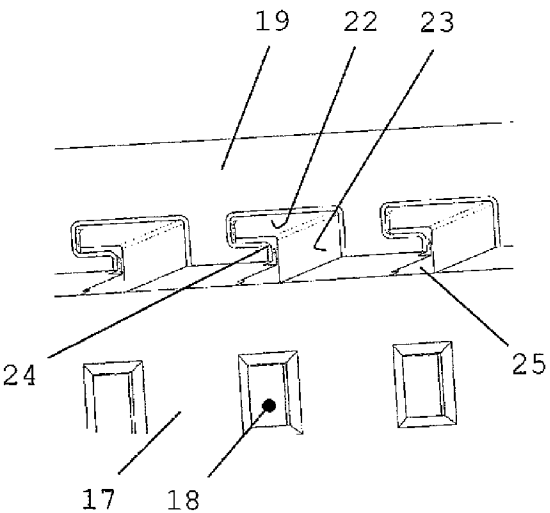
Figure 8B:
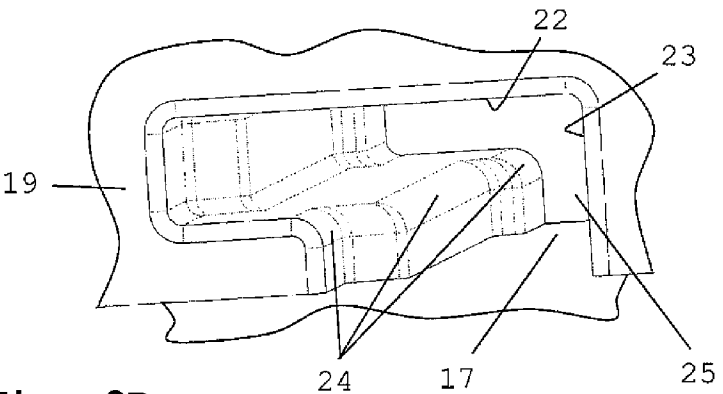

FIGS. 8A-8C are different views of the upper wall 19 of the housing 2, detailing aspects of the slots 6. Each slot 6 extends generally linear from the mating side to the rear side of the housing 2. As is most clearly visible in FIGS. 8B and 8C, each slot 6 comprises a cross-section perpendicular to the direction it extends in, which has an asymmetric profile resembling an inverted letter "L". The profile has an upper surface 22 a side surface 23 substantially perpendicular thereto and an interior corner 24. Each slot 6 extends a short distance into the dividing wall 17, forming a cavity 25. One or more slots 6 may extend fully through the dividing wall 17, forming a hole therethrough.

As is clearest visible in FIGS. 8A and 8B, the slots 6 comprise three portions 6A, 6B and 6C, with cross-sections having mutually different sizes. The portion 6A relatively closest to the mating side MS is narrower than the middle portion 6B which is again narrower than the portion 6C relatively closest to the rear side RS. Except for their widths, all portions 6A-6C have substantially the same shape in cross-section. As best seen in FIG. 8B, the transition from one size to the other is relatively gradually and rounded-off, as is the entrance to the slot 6 at the rear side RS. The surfaces 22 and 23 are plane and are common to all portions 6A-6C.

For assembling the connector 1, modules 3 are mounted into the housing 2 from the rear side RS, by fitting their rib 5 into a corresponding slot 6 in the housing (cf. FIG. 3). Each module 3 is inserted into the housing 2 until its terminals 4 extend through the passageways 18, its front side engages the dividing wall 17 and its mounting protrusion 13 is received in a recess 20.

The ribs 5 and slots 6 are sized such that their frontmost portions 5A, 6A and rearmost portions 5B, 6C interfere and form a relatively tight fit, with the angle 24 of the slot 6 pressing against the flaring side wall 10 of the rib 5. The net direction of the force exerted by the corner 24 on the wall 10 is towards the angle between the surfaces 9 and 11 of the rib 5, and the angle between the surfaces 22 and 23 of the slot 6, respectively, pressing the surfaces 9 and 22 and the surfaces 11 and 23 together. Preferably, the top surface 8 of the module 3 also engages the interior surface of the upper wall 19, more preferably on both sides of the slot 6.

The module 3 is thus substantially fixed in three positions: at or near the front and rear ends of the rib 5 and at the mounting protrusion 13, which preferably is received latchingly and/or with a tight fit into the recess 20. The passageways 18 and terminals 4 may also provide a latching- and/or tight fit.

Although the half dove-tail shape of the embodiment shown here is preferred, other asymmetric shapes may be employed for the rib 5 while still providing the directional force snugly pressing the rib 5 against two or more different structures or surfaces, therewith defining a relatively good true position for the module 3 with respect to the housing 2 in two or more directions.

To facilitate assembling the connector 1 and to prevent or reduce friction during insertion of the module 3 into the housing 2, the slot 6 becomes wider towards the rear side RS (portions 6B, 6C), such that it may act for providing easy entry of a rib 5 and thereafter for guiding and holding the rib 5 into the slot 6 substantially without hindering its movability until the last moment of insertion, when the parts undergo the interference fit. Thus, improved true positioning of the terminals with respect to the corresponding passageways is achieved. The interference fit occurs at two locations which are remote as far as possible from each other; in other words, a better positioning is achieved through the alignment of two distant away points, from which it is possible to draw only one axis.

The rib 5 and the slot 6 may have the same cross-sectional size throughout their full length. It is, however, preferred that one or more portions providing a relatively tight fit between the rib 5 and the slot 6 for fixing the module 3 and the housing 2 be located near the mating side MS, so as to reduce friction ensuing therefrom to the final stage or stages of the insertion process.

The recess 12 along the rib 5 allows for a radius at the line joining the surfaces 22 and 23 and enabling the surfaces 9 and 22 and the surfaces 11 and 23 to come into contact with each other substantially over their full surface areas. The recess 12 thus allows reducing demands on the manufacturing of the housing 2. The recess 12 may also substantially prevent small burrs which may remain in the slot from the manufacturing process and/or which may be scraped off the surfaces during insertion from hindering a good flat contact between the surfaces 9, 22 and 11, 23. Thus, the recess 12 assist to define relatively well the side-by-side and up-and-down positioning of a terminal module 3 within the housing 2.

Additionally, burrs or other debris which may be scraped off surfaces of the rib 5 and/or the slot 6 may be collected in the cavities 25, such that also the front-to-back (or: mating side-to-rear side) alignment of the module 3 with respect to the housing 2 may be relatively exact and may be substantially unaffected by the process of the assembly.

Since the relatively reliable positioning may apply to all modules 3 with respect to the housing 2, the positioning of the modules 3 with respect to each other can also be relatively exact. The relative position of adjacent modules may be further assisted by allowing the modules to touch or engage each other, or by providing the connector 1 with additional fixing means such as clamps etc.

Since the terminals 4 are molded into (the main bodies 7 of) the modules 3, which may be done relatively predictably and reliably, the relatively good positioning of the modules 3 in the housing 2 allows for the desired relatively good and stable true positioning of the contact terminals 4 within the connector 1.

Various connectors 1 may be assembled with different modules 3 according to different requirements. Correspondingly, the parts may be provided singly, as sets comprising a plurality of one or more parts or as a kit of parts for assembling a connector 1.

The invention is not restricted to the above described embodiment and can be varied in a number of ways within the scope of the appended claims. For instance, the housing may comprise one or more ribs and the modules may comprise a corresponding recess. A housing comprising a mixture of ribs and slots is also conceivable.

Ribs and slots may be provided with and/or formed as polarisation or keying structures.

Further, the mounting structure need not be a rib, but may be formed by two or more structures on the module, e.g. by leaving out a middle portion of the rib. This reduces material and possible friction during assembly of the connector, without substantially reducing the robustness of the connector.

The parts and/or the assembled connector may be fixed together, e.g. by being ultrasonically welded. Alternatively, the parts may be assembled so as to be replaceable, e.g. for exchange, modification and/or repair.

The invention claimed is:

1. Electrical connector, comprising at least two parts:

a housing having a mating side (MS) and a rear side (RS) and a terminal module having a mating side (MS) and a rear side (RS), one part comprises a mounting structure and the other part comprises a corresponding receiving structure for receiving the mounting structure of the other part, the mounting structure extending in a direction from the mating side (MS) to the rear side (RS) of the part, the module having a main plane, defined by a side surface of a contact terminal of that module, extending between the mating side and the rear side, wherein the mounting structure or receiving structure, respectively, of the module comprises two mutually substantially perpendicular surfaces, one of the surfaces of the mounting structure or the receiving structure, respectively, lying substantially in the main plane.

2. Electrical connector according to claim 1, wherein the mounting structure comprises a cross-section, perpendicular to the direction extending from the mating side to the rear side, having an asymmetric profile.

3. Electrical connector according to claim 1, wherein at least one of the mounting structure and the receiving structure comprises one or more portions providing a fitting arrangement between the structures.

4. Electrical connector according to claim 1, wherein the cross-section of the mounting structure comprises an asymmetric dove-tail profile.

5. Electrical connector according to claim 3, wherein the cross-section of the mounting structure comprises a half dove-tail profile.

6. Electrical connector according to claim 1, wherein the mounting structure is a mounting rib and the receiving structure is a receiving slot.

7. Electrical connector according to claim 1, wherein the mounting structure comprises at least two portions with the cross-sections having mutually different sizes.

8. Electrical connector according to claim 1, wherein the receiving structure comprises at least two, preferably at least three, portions with the cross-sections having mutually different sizes.

9. Electrical connector according to claim 1, wherein one part comprises an additional mounting structure and the other part comprises an additional receiving structure corresponding to the additional mounting structure.

10. Electrical connector according to claim 1, wherein the receiving structure comprises a portion configured for receiving dust, debris and/or burrs, e.g. caused by insertion of the mounting structure into the receiving structure.

11. Electrical connector according to claim 1, wherein the terminal module comprises the mounting structure and wherein the housing comprises the receiving structure.

12. Terminal module having a mating side (MS) and a rear side (RS), the terminal module comprising a housing receiving at least one terminal having a side surface, defining a main plane of the terminal module, said main plane extending between the mating side (MS) and the rear side (RS), the terminal module further comprising a mounting rib extending in a direction from the mating side (MS) to the rear side (RS) of the module, wherein the mounting rib comprises two mutually substantially perpendicular surfaces, one of which lying substantially in the main plane of the module.

13. An electrical connector module comprising:

a housing comprising a mounting structure, where the mounting structure comprises two substantially perpendicular surfaces, where the mounting structure extends in a direction from a mating side (MS) to the rear side (RS) of the module; and a plurality of contact terminals in the housing, where the module has a main plane extending between the mating side and the rear side, where side surfaces of the contact terminals are aligned in the main plane, where a first one of the surfaces of the mounting structure is aligned in the main plane.

14. An electrical connector module as in claim 13 where the mounting structure comprises a cross-section, perpendicular to the direction extending from the mating side to the rear side, having an asymmetric profile.

15. An electrical connector module as in claim 13 where the mounting structure comprises portions with different widths for providing a fitting arrangement with a corresponding receiving structure in a connector housing.

16. An electrical connector module as in claim 13 where a cross-section of the mounting structure comprises an asymmetric dove-tail profile.

17. An electrical connector module as in claim 13 where the mounting structure comprises at least two portions with cross-sections having mutually different sizes.

18. An electrical connector module as in claim 13 where the mounting structure comprises a cut-out recess at a junction between the two substantially perpendicular surfaces of the mounting structure.

* * * * *